US009067697B2

(12) United States Patent
Gruss et al.

(10) Patent No.: US 9,067,697 B2
(45) Date of Patent: Jun. 30, 2015

(54) DEVICE AND METHOD FOR METERING TOBACCO IN PORTIONS SUITABLE FOR PACKAGING

(75) Inventors: Thomas Gruss, Seevetal (DE); Patrick Fricke, Hamburg (DE); Stephan Plewa, Schloss Holte-Stukenbrock (DE); Hartmut Ringel, Oerlinghausen (DE); Bernd Seliger, Oerlinghausen (DE)

(73) Assignee: Hauni Maschinenbau AG, Hamburg (DE)

( * ) Notice: Subject to any disclaimer, the term of this patent is extended or adjusted under 35 U.S.C. 154(b) by 1087 days.

(21) Appl. No.: 13/128,180

(22) PCT Filed: Nov. 7, 2008

(86) PCT No.: PCT/EP2008/009617
§ 371 (c)(1),
(2), (4) Date: Jun. 14, 2011

(87) PCT Pub. No.: WO2010/051826
PCT Pub. Date: May 14, 2010

(65) Prior Publication Data

US 2011/0239591 A1 Oct. 6, 2011

(51) Int. Cl.
*B65B 1/24* (2006.01)
*B65B 1/36* (2006.01)
*B65B 29/00* (2006.01)

(52) U.S. Cl.
CPC .. *B65B 1/36* (2013.01); *B65B 29/00* (2013.01)

(58) Field of Classification Search
CPC ..... A24B 3/00
USPC ..... 131/111, 115
See application file for complete search history.

(56) References Cited

U.S. PATENT DOCUMENTS

| | | | | |
|---|---|---|---|---|
| 5,174,088 | A | 12/1992 | Focke et al. | |
| 2002/0187229 | A1 | 12/2002 | Fischer et al. | |
| 2008/0264432 | A1 * | 10/2008 | Moser et al. | 131/108 |

FOREIGN PATENT DOCUMENTS

| | | | |
|---|---|---|---|
| DE | 102005017474 | A1 | 10/2006 |
| EP | 1661810 | A1 | 5/2006 |
| JP | 19930138128 | | 12/1994 |
| JP | 2007069915 | A | 3/2007 |

(Continued)

OTHER PUBLICATIONS

International Search Report of PCT/EP2008/009617 Dated Jul. 7, 2009.

(Continued)

*Primary Examiner* — Galen Hauth
(74) *Attorney, Agent, or Firm* — Venable LLP; Robert Kinberg

(57) ABSTRACT

An apparatus and method for metering tobacco in portions suitable for packaging. The apparatus includes a feeding element for the tobacco and a device for forming and discharging at least one tobacco portion suitable for packaging. The device comprises a wiping element for wiping tobacco into a portioning chamber. The portioning chamber is variable in volume for compressing the tobacco and releasing the compressed tobacco portion. The portioning chamber is also displaceable relative to the wiping element for displacing from a filling position into a dispensing position and vice versa. An element for discharging the compressed tobacco portion is disposed in the area of the dispensing position.

22 Claims, 4 Drawing Sheets

(56) References Cited

FOREIGN PATENT DOCUMENTS

| | | | |
|---|---|---|---|
| WO | WO-2007/084060 | A1 | 7/2007 |
| WO | WO-2008/062301 | A1 | 5/2008 |

OTHER PUBLICATIONS

Office Action dated Apr. 2, 2013 in Japanese Patent Application 2011-535010 with English Translation.

* cited by examiner

DEVICE AND METHOD FOR METERING TOBACCO IN PORTIONS SUITABLE FOR PACKAGING

CROSS REFERENCE TO RELATED APPLICATION

The present application is a U.S. National Stage of International Application No. PCT/EP2008/009617, filed Nov. 7, 2008, designating the United States.

BACKGROUND OF THE INVENTION

1. Field of Invention

The invention concerns an apparatus for metering tobacco in portions suitable for packaging, comprising a feeding element for the tobacco and a device for forming and discharging at least one tobacco portion suitable for packaging. Furthermore the invention concerns a method for metering tobacco, in particular moist tobacco, in portions suitable for packaging.

2. Related Art

Apparatuses and methods of this kind are used in the tobacco-processing industry in order to process and in particular meter so-called snus tobacco. Snus tobacco is a so-called oral tobacco (or tobacco blends) which is introduced into the mouth directly or in a suitable package, e.g. a bag made of cellulose or the like, wherein the term "tobacco" includes not only exclusively the actual tobacco, but also tobacco with additives, aromas or the like. When unpackaged snus tobacco is taken, it is put directly in tins, boxes, combination packages or the like. The actual portioning suitable or ready for consumption is performed by the consumer himself. Snus tobacco which is taken in packaged form, namely e.g. in individual sealed-edge bags or the like, must be portioned and put in the bags beforehand. The tobacco portions, of which the weight and size can vary and is usually in the region of milligrammes and grammes, are divided off from a continuously or intermittently delivered flow of tobacco by means of metering devices and usually packaged by means of so-called sealed-edge bag machines, such as are known from DE 10 2005 017 474 A1.

From practical experience metering devices are known in which the feeding element is a funnel by means of which the tobacco is transported into the area of a device for forming and discharging a tobacco portion suitable for packaging. The known devices for forming and discharging the tobacco portions usually comprise a pre-portioning chamber or decompression chamber, which is connected to the funnel via a hose or the like. Inside the decompression chamber, the tobacco entering from the funnel is stored temporarily. Below the decompression chamber is usually arranged a microcylinder. By retracting the piston, tobacco is, so to speak, drawn out of the decompression chamber into the cylinder, wherein the volume of the portioning chamber formed by the retracted piston corresponds to a tobacco portion suitable for packaging. When the portioning chamber is full, the decompression chamber is moved relative to the microcylinder (or vice versa), so that the contents of the portioning chamber, namely one tobacco portion, can be discharged e.g. to a transport chamber or the like. This transport chamber can form e.g. a unit with the decompression chamber. After filling of the transport chamber with the metered tobacco portion, the transport chamber is moved into a dispensing position over an outlet opening, so that the tobacco portion drops down to a subsequent apparatus, namely e.g. the sealed-edge bag machine. While the transport chamber is over the outlet opening, the microcylinder can already again be filled with the next tobacco portion. Such metering devices are suitable for single-track and multiple-track sealed-edge bag machines.

Such metering devices have the drawback, however, that only free-flowing tobacco, that is, tobacco with a low residual moisture content, can be processed. To put it another way, only tobacco which has a residual moisture content of less than about 20% can be processed reliably. Even tobacco with a residual moisture content of less than about 20% to which additives are added can be processed only with difficulty or not at all, as the additives, aromas and the like further increase the moisture content, e.g. due to oils or the like. During the processing of such moist tobaccos, the tobacco adheres or sticks in particular in the area of the (partly curved) hoses or microcylinders, and after a short time leads to blockage of the device and hence stopping of the subsequent sealed-edge bag machine.

SUMMARY OF THE INVENTION

It is therefore an object of the invention to provide a simple and reliable apparatus for metering tobacco, in particular moist tobacco with a residual moisture content of more than about 20%. Furthermore, it is an object of the invention to propose a corresponding method.

This and other objects may be achieved by a device having the features mentioned hereinbefore by the fact that the device comprises a wiping element for wiping tobacco into a portioning chamber, wherein the portioning chamber is designed to be firstly variable in volume for compressing the tobacco and releasing the compressed tobacco portion and secondly displaceable relative to the wiping element for displacing from a filling position into a dispensing position and vice versa, and that an element for discharging the compressed tobacco portion is arranged in the area of the dispensing position. Due to the fact that the tobacco is already precompressed by the wiping action and finally compressed by the change in volume of the portioning chamber, a kind of tobacco stick is formed as a tobacco portion suitable for packaging, which can be discharged in a directed manner and—in relation to the device—almost without residue. In other words, the execution according to an embodiment of the invention ensures that the tobacco portion formed in the portioning chamber can be conveyed completely out of the device e.g. into a subsequent sealed-edge bag, by means of the element for discharging the finally compressed tobacco portion. By compressing the tobacco portion on the one hand and actively discharging the tobacco portion on the other hand, in particular moist tobacco or moist tobacco blends can also be metered reliably, so that such a device can be incorporated into a continuous packaging process.

According to an embodiment of the invention, the portioning chamber is composed of two slide elements which are spaced apart from each other and guided within a base plate, wherein the two slide elements are designed to be movable linearly towards and away from each other. Due to these slide elements, compression of the tobacco and release of the compressed tobacco can be carried out in a particularly effective manner.

Advantageously, the two slide elements at the ends facing towards each other each have a contour which is semicircular in plan view, such that, when the slide elements are pulled apart, the portioning chamber is slot-shaped in plan view, and when the slide elements are pushed together to form a cylindrical tobacco portion, the portioning chamber is cylindrical. Hence firstly a volume which corresponds to the desired tobacco portion is formed, and secondly a particularly suitable shape of the tobacco portion is obtained for handling or further processing, that is, for transport of the tobacco portion out of the metering device into a packaging machine or the like, as a result of which contamination or even blockage of the device by tobacco residues, which hinders the metering operation, can be avoided.

A further embodiment of the invention is characterised in that the wiping element is rotatable in both directions about a centre axis which is directed perpendicularly to the base plate. By rotation of the wiping element in both directions, the tobacco can be wiped particularly reliably into the portioning chamber by rotation of the wiping element back and forth, so that precise filling/metering is guaranteed. Rotation back and forth can take place in a rapid oscillating movement, which can also inherently have different speeds for each rotation.

According to an embodiment of the invention, the wiping element is assigned a detection means for monitoring the level. With this development according to an embodiment of the invention, overfilling with tobacco, which could lead to a blockage, and underfilling with tobacco, which could lead to a stand-still of the subsequent apparatus, are effectively prevented.

According to an embodiment of the invention, a method mentioned hereinbefore is characterised by the following steps: feeding tobacco, forming a tobacco portion by wiping the tobacco into a portioning chamber by means of a wiping element in a filling position of the portioning chamber, displacing the portioning chamber and hence the pre-compressed tobacco portion relative to the wiping element out of the filling position towards a dispensing position, finally compressing the pre-compressed tobacco portion by a change of volume of the portioning chamber, displacing the finally compressed tobacco portion into the dispensing position, and discharging the finally compressed tobacco portion. The resulting advantages have already been described in connection with the apparatus according to an embodiment of the invention, so that reference is made to the corresponding passages to avoid repetition.

BRIEF DESCRIPTION OF THE DRAWINGS

Further features and developments according to an embodiment of the invention are apparent from the subsidiary claims and the description. Some example embodiments as well as the principle of the method will be described in more detail with the aid of the attached drawings. The drawings show:

DETAILED DESCRIPTION

Figure 1:
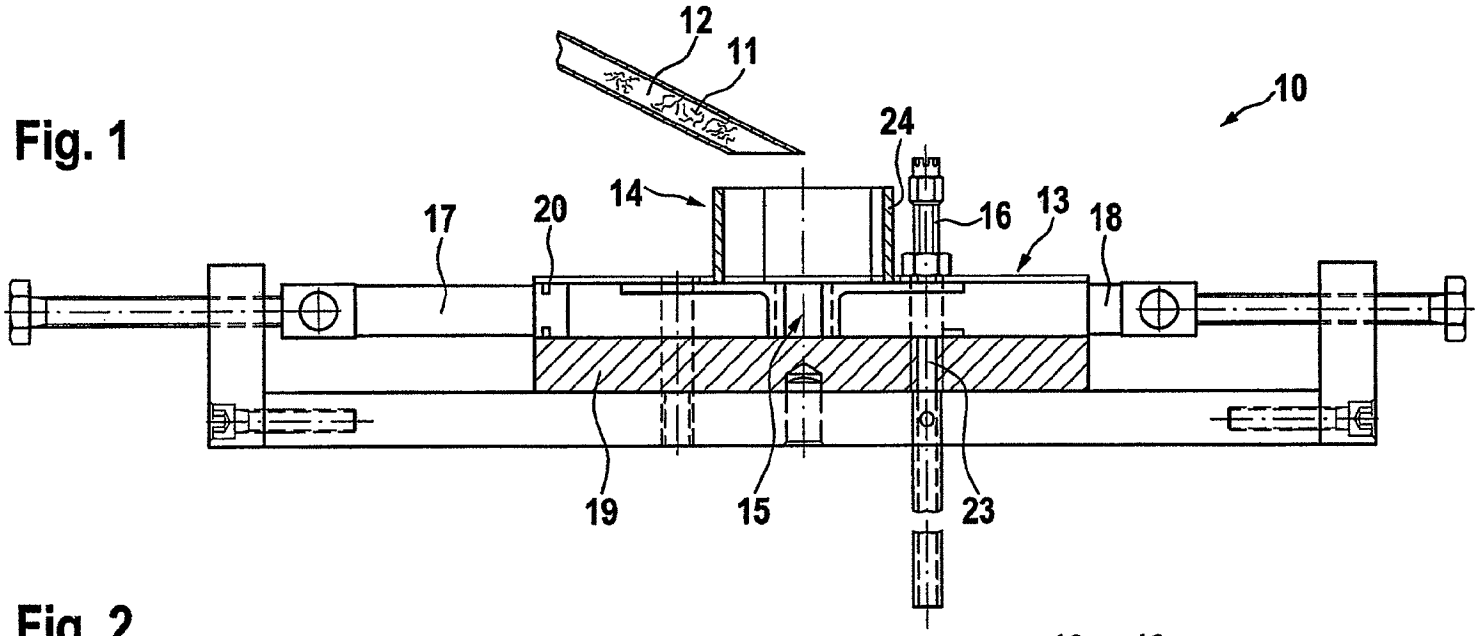
FIG. 1 depicts a schematic side view of the apparatus according to an embodiment of the invention for metering tobacco, in partial section.

The apparatuses shown in the drawings are used for metering moist tobacco in portions suitable for packaging. Naturally, the apparatuses are also suitable for metering tobacco with a residual moisture content of less than 20% as well as tobacco blends.

Figure 3:
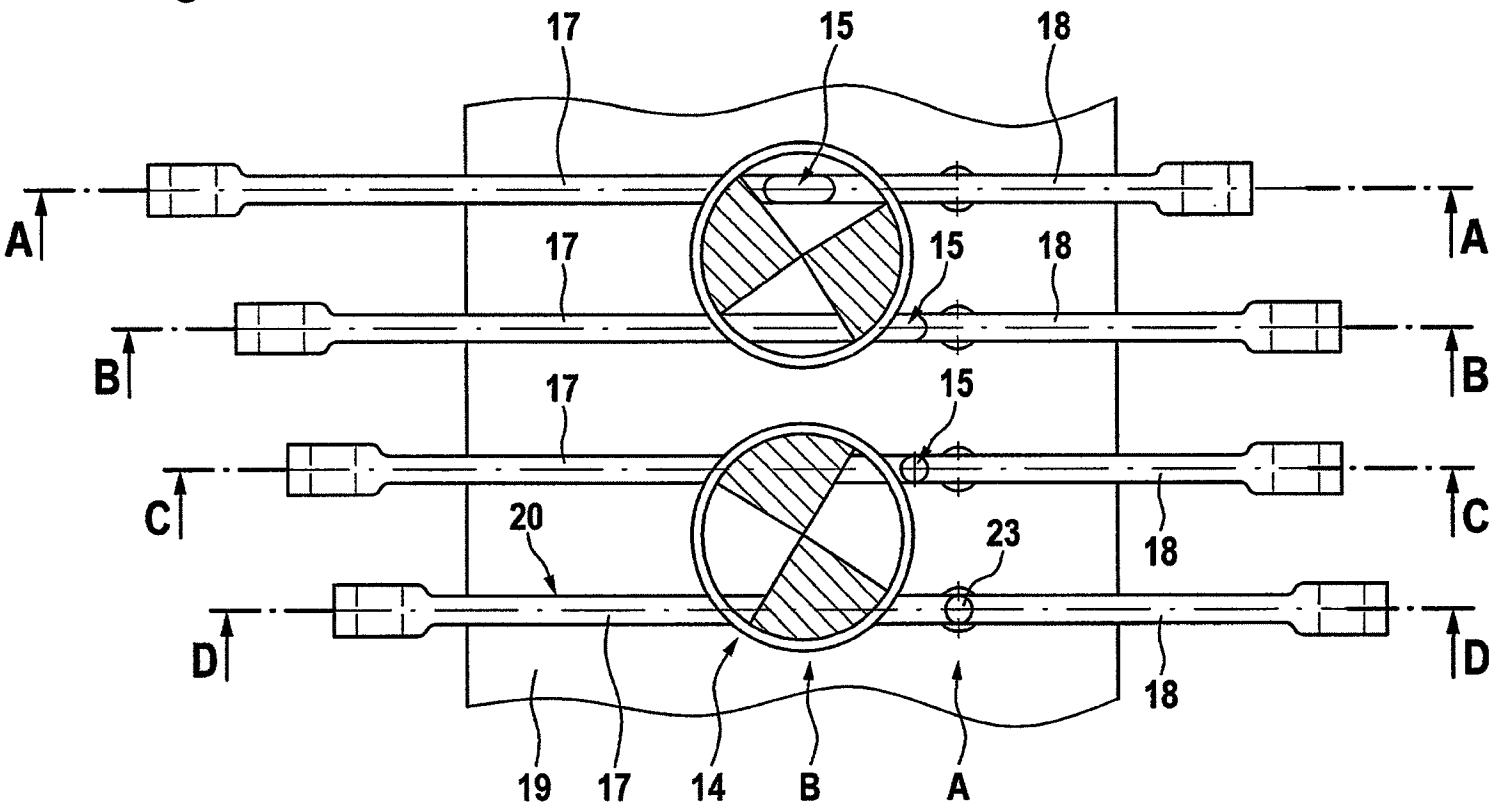
FIG. 3 depicts a plan view of an apparatus according to an embodiment of the invention for metering tobacco, with slide elements in different positions.

According to an embodiment, the apparatus 10 shown in FIG. 1 for metering tobacco 11 in portions suitable for packaging comprises a feeding element 12 for the tobacco 11 as well as a device 13 for forming and discharging at least one tobacco portion suitable for packaging. Naturally, the device 13 for forming and discharging the tobacco portions can be filled manually as well. Within the scope of automation, however, a feeding element 12 is self-evident. The device 13 has a wiping element 14 for wiping tobacco 11 into a portioning chamber 15. The wiping element 14 in further embodiments (see e.g. FIG. 3) can also be constructed and designed for wiping tobacco 11 into several portioning chambers 15. The or each portioning chamber 15 is designed to be variable in volume, this being firstly for compressing the tobacco 11 and secondly for releasing the compressed tobacco portion. Furthermore, the or each portioning chamber 15 is movable relative to the wiping element 14. The relative movement is preferably linearly oriented. Due to the relative movement between the wiping element 14 and the portioning chamber 15, the portioning chamber 15 or the tobacco portion contained therein can be moved out of a filling position B into a dispensing position A and vice versa. Furthermore, the apparatus 10 comprises in the area of the dispensing position A an element 16 for bringing out the compressed tobacco portion.

Figure 2:
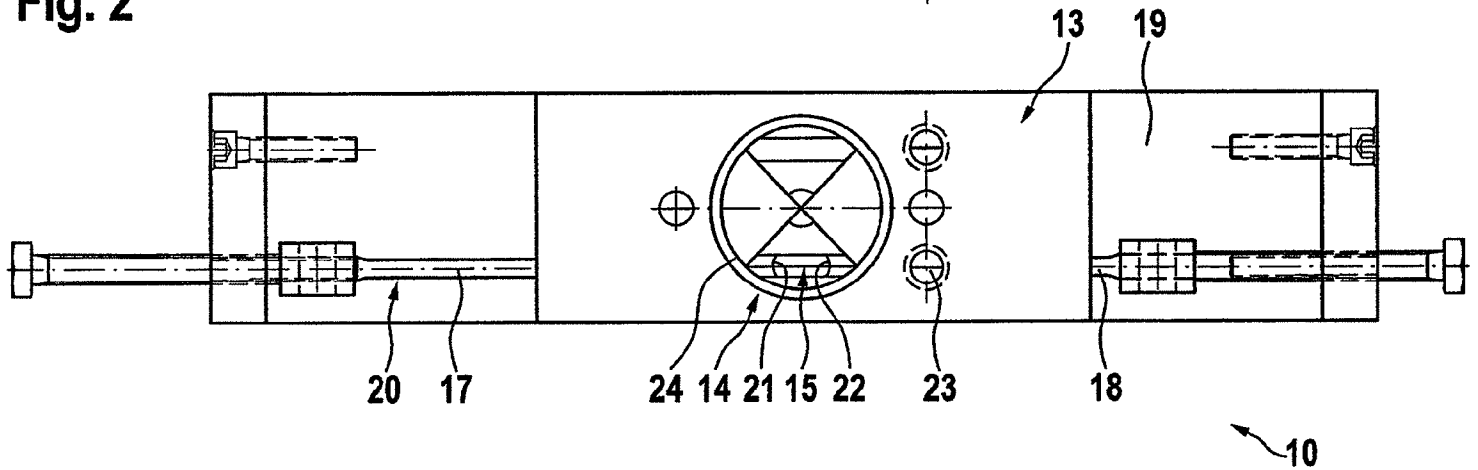
FIG. 2 depicts a plan view of the apparatus according to FIG. 1.

The or each portioning chamber 15 is composed of two slide elements 17, 18 in the embodiment shown. These slide elements 17, 18 are guided in a base plate 19. This means that within the base plate 19 is formed e.g. a groove 20 in which the two rod-shaped slide elements 17, 18 are guided. The two spaced-apart slide elements 17, 18 are designed to be movable towards and away from each other by suitable drive means, for example hydraulically, pneumatically, mechanically and/or by means of servo motors. The slide elements 17, 18 are preferably arranged in the same, continuous groove 20. The slide elements 17, 18 movable back and forth in the groove 20 each have, at the ends 21, 22 facing towards each other, a semicircular contour in plan view (see e.g. FIG. 3). To put it another way, the ends 21, 22 are concave, that is, curved inwardly. As a result, the portioning chamber 15 is slot-shaped in plan view (see e.g. FIG. 2) when the slide elements 17, 18 are pulled apart, and circular in plan view to form a cylindrical body (see e.g. bottom of FIG. 3) when the slide elements 17, 18 are pushed together. By this means a tobacco portion filled or wiped into the portioning chamber 15 can be shaped into a cylindrical tobacco stick, wherein the size of the portioning chamber 15 is variable or adjustable in the pushed-together state of the slide elements 17, 18, and is selected e.g. to form a tobacco stick with a length of about 14 mm and a diameter of about 6 mm. Naturally, the dimensions of the tobacco stick can vary as well, and the ends 21, 22 can also have a different contour. Also, guiding of the slide elements 17, 18 or other compressing elements can be carried out in a manner which is not shown explicitly, for example by guide rails, profiles or the like.

The portioning chamber 15 in the described embodiment is bounded laterally by the slide elements 17, 18 and at the bottom by the base plate 19, when the slide elements 17, 18 are pushed together. "Pushed together" in this context means that the ends 21, 22 of the slide elements 17, 18 are in contact, so that the concave contours of the slide elements 17, 18 in plan view form a circle. When the slide elements 17, 18 are pulled apart, the portioning chamber 15 is bounded laterally on the one hand by the slide elements 17, 18 and additionally by the base plate 19 or, to be more precise, by the side walls of the groove 20. At the bottom the portioning chamber 15 is bounded by the base plate 19. In the direction of the wiping element 14, in this example at the top, the portioning chamber 15 is open in the area of the filling position B and the dispensing position A. The structural design of the portioning chamber 15 can also be different for example by the fact that the portioning chamber 15 is bounded at the bottom by a separate plate or the like or by additional flap or slide elements.

As already mentioned, the portioning chamber 15 is movable out of a filling position B into a dispensing position A. To be more precise, the tobacco portion which is in the portioning chamber 15 is movable linearly and preferably horizontally by displacing the slide elements 17, 18 out of the filling position B below the wiping element 14 into the dispensing position A above an outlet opening 23. The outlet opening 23 is formed within the base plate 19. The outlet opening 23 is located within the guide, namely the groove 20 for the slide elements 17, 18. To put it another way, the outlet opening lies in the path of movement of the slide elements 17, 18. The diameter of the outlet opening 23 corresponds at least to the diameter of the portioning chamber 15, which is cylindrical in the dispensing position, and is preferably slightly larger than the diameter of the finally compressed cylindrical tobacco portion.

As described above, the wiping element 14 is arranged on the base plate 19. In the filling position B for the portioning chamber 15, the latter is arranged directly below the wiping element 14. In the dispensing position A of the portioning chamber 15, the wiping element 14 is bounded or closed at the bottom by the base plate 19 or the slide elements 17, 18 guided in the groove 20, so that no tobacco 11 can be carried away downwardly out of the wiping element 14. The wiping element 14 is designed to be movable relative to the base plate 19. This relative movement can be performed by moving the wiping element relative to the stationary base plate 19, by moving the base plate 19 relative to the wiping element 14, or by a superimposed movement of wiping element 14 and base plate 19. Preferably, the wiping element 14 is rotatable about an axis M in both directions to perform an oscillating movement. The axis M is essentially perpendicular to the base plate 19. In other embodiments the wiping element 14 can also be moved in rotation in one direction or linearly back and forth. Also, the wiping element 14 or its centre axis M can be oriented at an angle to the base plate 19.

Figure 5:
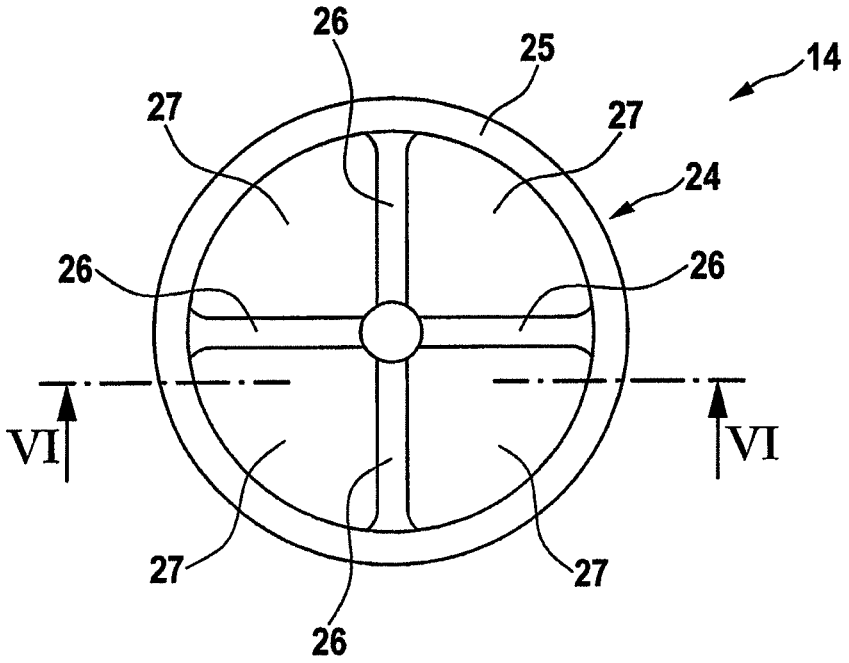
FIG. 5 depicts a plan view of a turnstile as the wiping element.
Figure 6:
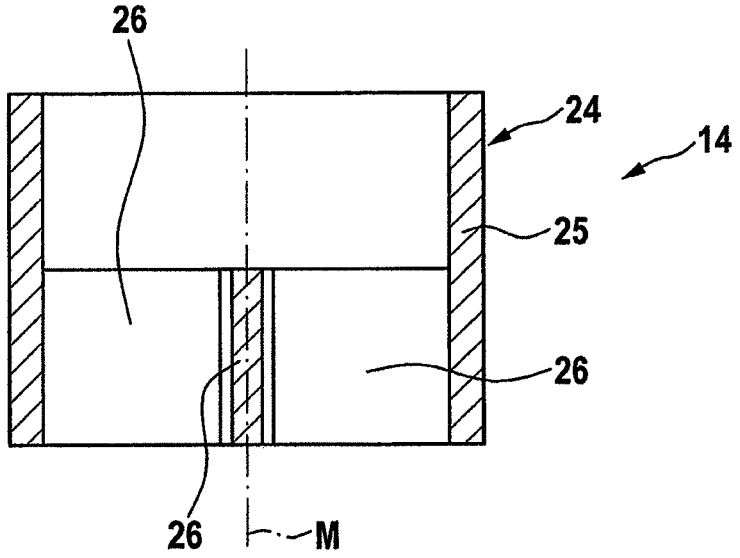
FIG. 6 depicts a side view of a turnstile in section along section line VI-VI according to FIG. 5.

The wiping element 14 is constructed as a turnstile 24. The turnstile 24 is composed of a hollow cylindrical body 25 as the shell part. The interior of the hollow body 25 is divided by partitions 26 or the like. The hollow body 25 can have one or two chambers 27 (see e.g. FIG. 3). Preferably, however, the turnstile 24 has four chambers 27 (see e.g. FIG. 5). Each chamber 27 serves to receive the delivered tobacco 11. As mentioned, the chambers 27 are separated from each other by the partitions 26. To even out the tobacco 11 within the turnstile 24, however, the partitions 26 can extend over only part of the height of the cylindrical shell part, as can be seen from FIG. 6. However, the partitions 26 can also extend over the full height. Other embodiments and in particular also the division of the interior and the design and arrangement of the partitions 26 are possible.

The wiping element 14 and the turnstile 24 described in the embodiment are assigned a detection means (not shown explicitly) for monitoring the level. The detection means can work optically, mechanically or in some other ordinary way, and is preferably connected to a control means (also not shown explicitly). By the control means, the detection means is operatively connected to the feeding element 12. The feeding element 12 is preferably a vibration channel, but can also be an ordinary chute, a vibrating element or the like. The control means may further be connected to the drives for the slide elements 17, 18 and for the wiping element 14. The element 16 for discharging the finally compressed tobacco portion of the portioning chamber 15 can be e.g. a nozzle for ejection by means of compressed air. However, the element 16 can also be a mechanical plunger or the like. Other elements 16 for pressing, pushing, sucking, etc. can be used as well.

Such apparatuses 10 according to an embodiment of the invention can be used as a separate unit e.g. as a conversion kit for existing machines or apparatuses. However, the described apparatuses 10 can also form part of e.g. a sealed-edge bag machine for making tobacco-filled sealed-edge bags. Furthermore, the apparatus 10 described, which is designed for the metering of tobacco for a single-track sealed-edge bag machine, can also be adapted for multiple-track sealed-edge bag machines.

Figure 4A:
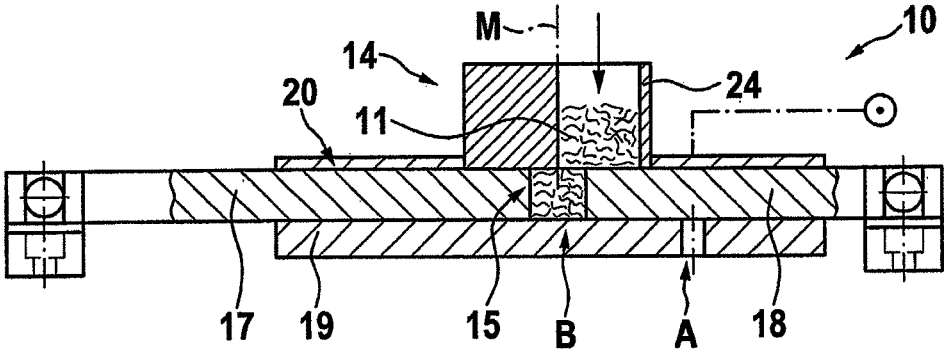
FIGS. 4*a-d* depict side views of the apparatus in section along section lines A-A, B-B, C-C and D-D in FIG. 3, respectively.
Figure 4B:
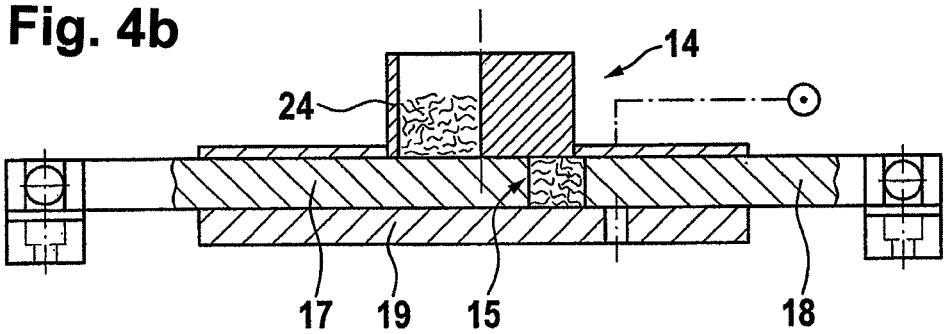

Below, the principle of an embodiment of the method will be described in more detail with the aid of the figures. Tobacco 11 is fed to the apparatus 10 irrespective of its residual moisture content, but in particular also tobacco 11 with a residual moisture content of more than 20%. This is done manually or via the feeding element 12. The tobacco 11 drops into the wiping element 14 or, to be more precise, into the chambers 27 of the turnstile 24. The turnstile 24 is driven in rotation, this being preferably in oscillation (also at different speeds), so that the tobacco 11 is wiped into the portioning chamber 15 located below the turnstile 24 in the filling position B (see e.g. FIGS. 3 and 4*a*). As a result, a tobacco portion is formed and (slightly) pre-compressed in the portioning chamber 15. As soon as the portioning chamber 15 contains a complete tobacco portion, that is, when the portioning chamber 15 is full, the slide elements 17, 18 move concertedly (without a change of volume) out of the area of the filling position B towards the dispensing position A (see e.g. FIGS. 3 and 4*b*). By this means the portioning chamber 15, which is defined essentially by the slide elements 17, 18, is displaced linearly and horizontally relative to the turnstile 24, so that the tobacco portion is, as it were, sheared off from the entering tobacco 11.

Figure 4C:
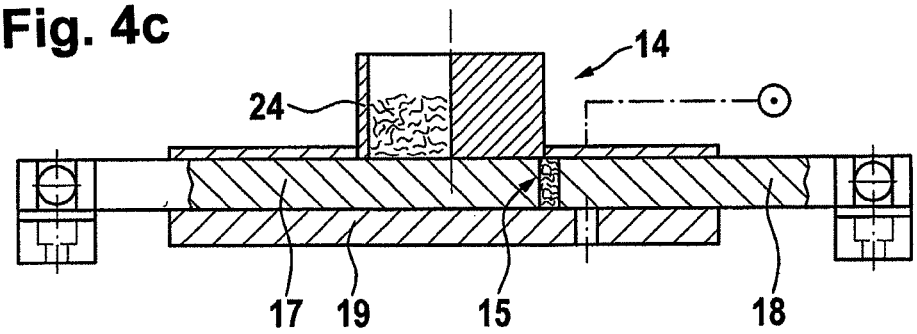
Figure 4D:
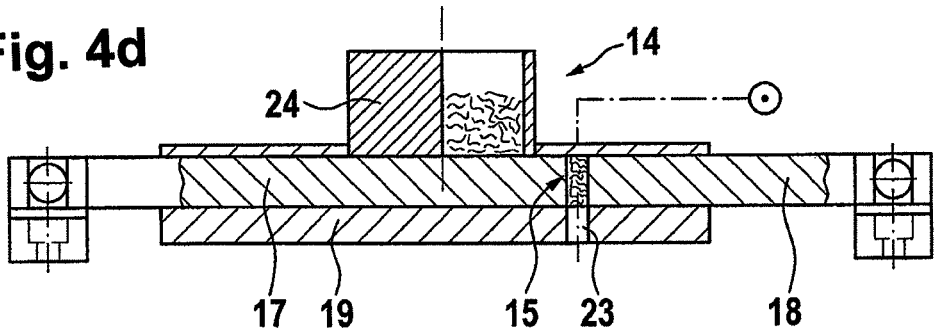

As soon as the portioning chamber 15 is located outside the range of the turnstile 24, the volume of the portioning chamber 15 is changed, namely in particular reduced, in order to compress the tobacco portion. This change of volume is achieved by pushing the slide elements 17, 18 together (see e.g. FIGS. 3 and 4*c*). In the process one slide element 17 or 18 can be moved relative to the other slide element 18 or 17, or both slide elements 17, 18 can be moved towards each other. Guiding of the slide elements 17, 18 takes place within a groove 20 in the base plate 19. During final compression, the portioning chamber 15 is closed at the top by a suitable device. The latter can be e.g. a lid-like device which covers the groove 20 in this area. As soon as the tobacco portion is finally compressed, that is, when the slide elements 17, 18 are pushed together to the maximum and have formed from the tobacco 11 a cylindrical (or, depending on the contour of the slide elements 17, 18, otherwise shaped) tobacco stick, the tobacco stick is moved on in the direction of the dispensing position A over the outlet opening 23, by driving or moving the slide elements 17, 18 concertedly. As soon as the tobacco stick is located over the outlet opening 23 (see e.g. FIGS. 3 and 4*d*), the tobacco stick is discharged. This can be done by the element 16, by blowing out the tobacco stick. However, the tobacco stick can also be pushed out or otherwise removed from the portioning chamber 15. To simplify or assist the discharging, the slide elements 17, 18 can easily be opened when or just before the tobacco stick is discharged, by moving the slide elements 17, 18 slightly away from each other. The tobacco portions which are metered and discharged in the manner described correspond to a portion suitable for packaging and form the contents of a single sealed-edge bag.

In further optional steps according to an embodiment of the invention, final compression of the pre-compressed tobacco portions and displacement of the finally compressed tobacco portions into the dispensing position A can be superimposed, in order to shorten the process time. Displacement of the portioning chamber 15 or of the slide elements 17, 18 relative to the wiping element 14 out of the filling position B towards the dispensing position A takes place initially preferably while retaining the volume of the portioning chamber 15. That is to say, the tobacco portion is moved out of the area of the filling position B before actual final compression, so that during final compression the tobacco portion is prevented from being pushed out of the portioning chamber 15 back into the chambers 27 of the turnstile 24.

As already mentioned, it is preferable to carry out wiping of the tobacco 11 into the portioning chamber 15 by an oscillating movement. This prevents so-called cones of material from forming in the area of the turnstile 24. Due to the rotation, preferably twice back and forth, each with a half-turn, a potentially forming heap of tobacco 11 is immediately levelled again.

Naturally, a uniform or rotating or linear movement can also be used for wiping.

Optionally, the tobacco 11 can be sieved before feeding. The tobacco 11 can optionally be sieved directly into the turnstile 24. Alternatively, the tobacco 11 can be sieved onto the vibration channel as the feeding element 12. In any case, according to an embodiment of the invention, the level in the turnstile 24 is optionally monitored in order to control the flow of tobacco 11 into the turnstile 24.

In order to coordinate the apparatus 10 and the subsequent machine with each other, it may be sensible to adapt the connection element, for example a pipe, in diameter to the diameter of the cylindrical tobacco portion or of the outlet opening 23. Preferably, the inside diameter of the pipe is slightly larger than the diameter of the outlet opening 23. This is particularly important in the variant of ejection of the cylindrical tobacco portion (tobacco stick) by means of compressed air. During ejection of the tobacco portion by means of compressed air, it may be advantageous to provide an additional volume of air in order to achieve planar blasting of the tobacco portion.

While various embodiments of the present invention have been described above, it should be understood that they have been presented by way of example only, and not limitation. Thus, the breadth and scope of the present invention should not be limited by any of the above-described embodiments, but should instead be defined only in accordance with the following claims and their equivalents.

The invention claimed is:

1. An apparatus for metering tobacco in portions suitable for packaging, comprising:

a feeding element configured to feed tobacco; and a device configured to form and discharge at least one tobacco portion suitable for packaging, wherein the device comprises a wiping element, a base plate and two slide elements operatively disposed in a guide in the base plate, a portioning chamber, and a discharging element, wherein the wiping element is arranged to wipe the tobacco received from the feeding element into the portioning chamber, wherein the portioning chamber is variable in volume for compressing the tobacco and releasing a compressed tobacco portion, and wherein the portioning chamber is displaceable relative to the wiping element between a filling position and a dispensing position and vice versa, and wherein the portioning chamber is defined by the two slide elements spaced apart from each other and guided within the guide in the base plate, and wherein the two slide elements are movable linearly towards and away from each other to vary the volume of the portioning chamber, and wherein, when the slide elements are pushed together, the portioning chamber is bounded laterally by the slide elements and at the bottom by the base plate, and, wherein, when the slide elements are pulled apart from one another, the portioning chamber is bounded laterally by the base plate and the slide elements, and wherein the discharging element is configured to discharge the compressed tobacco portion from the portioning chamber and is disposed in an area of the dispensing position.

2. An apparatus for metering tobacco in portions suitable for packaging, comprising:

a feeding element configured to feed tobacco; and a device configured to form and discharge at least one tobacco portion suitable for packaging, wherein the device comprises a wiping element, a base plate and two slide elements operatively disposed in a guide in the base plate, a portioning chamber, and a discharging element, wherein the wiping element is arranged to wipe the tobacco received from the feeding element into the portioning chamber, wherein the portioning chamber is variable in volume for compressing the tobacco and releasing a compressed tobacco portion, and wherein the portioning chamber is displaceable relative to the wiping element between a filling position and a dispensing position and vice versa, and wherein the portioning chamber is defined by the two slide elements spaced apart from each other and guided within the guide in the base plate, and a downwardly directed outlet opening defined within the guide in the base plate proximate the dispensing position, wherein a diameter of the outlet opening is slightly larger than a diameter of the compressed cylindrical tobacco portion, and wherein the two slide elements are movable linearly towards and away from each other to vary the volume of the portioning chamber, and wherein the two slide elements comprise ends facing towards each other, each end having a semicircular contour in plan view, whereby, when the slide elements are pulled apart, the portioning chamber is slot-shaped in plan view, and when the slide elements are pushed together, the portioning chamber is cylindrical to form a compressed cylindrical tobacco portion, and wherein the discharging element is configured to discharge the compressed tobacco portion from the portioning chamber and is disposed in an area of the dispensing position.

3. An apparatus for metering tobacco in portions suitable for packaging, comprising:

a feeding element configured to feed tobacco; and a device configured to form and discharge at least one tobacco portion suitable for packaging, wherein the device comprises a wiping element, a base plate and two slide elements operatively disposed in a guide in the base plate, a portioning chamber, and a discharging element, wherein the wiping element is arranged to wipe the tobacco received from the feeding element into the portioning chamber, and wherein the wiping element is arranged on the base plate and above the portioning chamber, and wherein the wiping element is movable relative to the base plate and wherein the wiping element is rotatable in both directions about an axis extending perpendicular to the base plate wherein the portioning chamber is variable in volume for compressing the tobacco and releasing a compressed tobacco portion, and wherein the portioning chamber is displaceable relative to the wiping element between a filling position and a dispensing position and vice versa, and wherein the portioning chamber is defined by the two slide elements spaced apart from each other and guided within the guide in the base plate, and wherein the two slide elements are movable linearly towards and away from each other to vary the volume of the portioning chamber, and wherein the discharging element is configured to discharge the compressed tobacco portion from the portioning chamber and is disposed in an area of the dispensing position.

4. An apparatus for metering tobacco in portions suitable for packaging, comprising:

a feeding element configured to feed tobacco; and a device configured to form and discharge at least one tobacco portion suitable for packaging, wherein the device comprises a wiping element, a base plate and two slide elements operatively disposed in a guide in the base plate, a portioning chamber, and a discharging element, wherein the wiping element is arranged to wipe the tobacco received from the feeding element into the portioning chamber, and wherein the wiping element is arranged on the base plate and above the portioning chamber, and wherein the wiping element is movable relative to the base plate and wherein the wiping element comprises a turnstile having at least one chamber for receiving the tobacco fed by the feeding element wherein the portioning chamber is variable in volume for compressing the tobacco and releasing a compressed tobacco portion, and wherein the portioning chamber is displaceable relative to the wiping element between a filling position and a dispensing position and vice versa, and wherein the portioning chamber is defined by two slide elements spaced apart from each other and guided within the guide in the base plate, and wherein the two slide elements are movable linearly towards and away from each other to vary the volume of the portioning chamber, and wherein the discharging element is configured to discharge the compressed tobacco portion from the portioning chamber and is disposed in an area of the dispensing position.

5. The apparatus according to claim 4, wherein the turnstile includes at least two chambers separated from each other by partitions.

6. The apparatus according to claim 5, wherein the partitions extend over only part of a height of a cylindrical shell part of the turnstile, starting from an end of the shell part facing towards the base plate.

7. The apparatus according to claim 4, wherein the wiping element comprises a detection mechanism arranged to monitor a level of tobacco received in the wiping element.

8. The apparatus according to claim 1, wherein the feeding element comprises a vibration channel, a chute, or a vibrating element.

9. The apparatus according to claim 7, wherein the detection means mechanism and the feeding element are operatively connected to each other by a control means.

10. The apparatus according to claim 1, wherein the portioning chamber is configured to move linearly relative to the wiping element.

11. A method for metering tobacco in portions suitable for packaging, comprising:

feeding tobacco via a feeding element, forming a tobacco portion by wiping the tobacco with a wiping element into a portioning chamber positioned in a filling position, displacing the portioning chamber relative to the wiping element from the filling position towards a dispensing position, compressing the tobacco portion by varying a volume of the portioning chamber defined by two slide elements spaced apart from each other and guided within a guide in a base plate, and wherein the two slide elements are movable linearly towards and away from each other to vary the volume of the portioning chamber, and wherein, when the slide elements are pushed together, the portioning chamber is bounded laterally by the slide elements and at the bottom by the base plate, and, wherein, when the slide elements are pulled apart from one another, the portioning chamber is bounded laterally by the base plate and the slide elements, displacing the compressed tobacco portion in the portioning chamber into the dispensing position, and discharging the finally compressed tobacco portion with a discharging element disposed in an area of the dispensing position from the portioning chamber.

12. The method according to claim 11, wherein the compressing comprises forming a compressed cylindrical tobacco portion.

13. The method according to claim 11, wherein the compressing of the tobacco portion and displacing of the compressed tobacco portion into the dispensing position occur simultaneously.

14. The method according to claim 11, wherein the displacing of the portioning chamber relative to the wiping element from the filling position towards the dispensing position is effected while retaining the volume of the portioning chamber.

15. The method according to claim 11, wherein the wiping of the tobacco into the portioning chamber is effected by an oscillating movement of the wiping element.

16. The method according to claim 12, wherein the discharging comprises opening the portioning chamber by moving the slide elements away from one another when the compressed tobacco portion is located above an outlet opening at the dispensing position.

17. The method according to claim 11, wherein the discharging of the compressed tobacco portion comprises ejecting the compressed tobacco portion with compressed air and/or mechanically.

18. The method according to claim 11, further comprising sieving the tobacco before feeding.

19. The method according to claim 11, wherein the feeding element comprises a vibration channel, a chute, or a vibrating element, and wherein the wiping element comprises a turnstile.

20. The method according to claim 19, further comprising monitoring a level of tobacco received in the turnstile.

21. The apparatus according to claim 5, wherein the turnstile includes four chambers separated from each other by partitions.

22. The apparatus according to claim 1, wherein the discharging element comprises a pneumatically and/or mechanically operating work element.

* * * * *